US007465947B2

(12) United States Patent
Magram

(10) Patent No.: US 7,465,947 B2
(45) Date of Patent: Dec. 16, 2008

(54) X-RAY SHIELD ARRANGEMENT FOR OPERATING ROOM

(76) Inventor: Martin Yale Magram, 3611 Gardenview Rd., Baltimore, MD (US) 21208

( * ) Notice: Subject to any disclaimer, the term of this patent is extended or adjusted under 35 U.S.C. 154(b) by 417 days.

(21) Appl. No.: 11/381,028

(22) Filed: May 1, 2006

(65) Prior Publication Data

US 2007/0252095 A1 Nov. 1, 2007

(51) Int. Cl.
*G21F 3/00* (2006.01)

(52) U.S. Cl. ..... 250/515.1; 250/505.1; 378/203

(58) Field of Classification Search ..... 250/515.1, 250/505.1; 378/203
See application file for complete search history.

(56) References Cited

U.S. PATENT DOCUMENTS 3,308,297 A * 3/1967 Mansker ..... 250/515.1
4,280,056 A * 7/1981 Renshaw ..... 250/515.1
4,620,863 A * 11/1986 Tomozawa et al. ..... 65/30.12
4,965,456 A * 10/1990 Huettenrauch et al. ... 250/515.1
5,185,778 A * 2/1993 Magram ..... 378/196
7,057,194 B2 * 6/2006 Goldstein ..... 250/515.1
7,112,811 B2 * 9/2006 Lemer ..... 250/515.1
2007/0075277 A1 * 4/2007 Smith et al. ..... 250/515.1

OTHER PUBLICATIONS

Catalog P-2, "Diagnostic Imaging Instruments and Accessories for Cardiac Cath, Special Procedures, Urology, Orthopedic Surgery, Operating Rooms," Nuclear Associates, Division of Victoreen, Inc., Carle Place, NY.
AADCO Medical, Inc., X-Ray Protection Devices, www.aadcomed.com, Randolph, VT.
RayShield X-Ray Barriers, 1-800-225-9014.

* cited by examiner

*Primary Examiner*—Jack I Berman
*Assistant Examiner*—Michael J Logie
(74) *Attorney, Agent, or Firm*—Lowe Hauptman Ham & Berner LLP

(57) ABSTRACT

Back-scattered x-rays incident on a person working with a patient on an operating table are reduced by upper and lower x-ray shield panels mounted so they can be turned relative to each other about a common vertical axis. The panels are thick enough and have proximate horizontal edges close enough to each other to substantially attenuate the back-scattered x-rays incident on front faces of the panels and a gap between the edges while the panels are aligned. The panels pivot about the vertical axis to form an opening enabling the person's hand(s) and forearm(s) to extend through. A hinge connects the upper and lower panels to a third panel. In a second embodiment, the upper and lower panels are moved up and down together, while the lower panel remains aligned with a fixed fourth panel for protecting the person's legs.

16 Claims, 6 Drawing Sheets

X-RAY SHIELD ARRANGEMENT FOR OPERATING ROOM

FIELD OF THE INVENTION

The present invention relates generally to a shielding apparatus and method for an operating room equipped with x-ray diagnostic equipment and more particularly to such a method and apparatus wherein an x-ray shield panel includes at least two segments, capable of turning relative to each other about a substantially vertical axis.

BACKGROUND ART

Modern operating rooms typically include a table on which a patient lies during the operating procedure, and diagnostic equipment in the form of an x-ray source and an x-ray detector, is located on a gantry with the patient and operating table between the x-ray source and detector. The gantry is rotatable about a horizontal axis so that a surgeon viewing a display responsive to the detector is provided with real time display of the tissue being operated on. During the procedure, the patient is irradiated by x-rays for prolonged intervals and is moved relative to the source of x-rays by providing the table with motors and a linkage that move the table and patient relative to the platform in a plane parallel to the floor. At other times, it is essential that the table and patient remain stationary, a result achieved by providing the table with a braking arrangement for holding the table in situ relative to the platform.

The x-ray source can be activated to different intensity levels. The x-ray source is activated to a high intensity level, referred to as the cine mode, to provide an intensity sufficient to expose cine film and to provide fluoroscopy. The x-ray source is activated to a lower intensity, referred to as the fluoroscopy mode, when only fluoroscopy and no exposure of cine film is required. Typically, there is approximately a 4:1 ratio between the intensity level of the cine and fluoroscopy modes.

Because the surgeon and one or more assistants stand next to the operating table, they are constantly exposed to x-rays back-scattered from the patient and/or table unless adequate shielding is provided. The accumulated effect of the back-scattered radiation over many years of conducting surgical procedures may have deleterious effects on the health of the surgeon and assistant(s), and may induce cancer.

In an attempt to reduce the x-ray exposure to a surgeon and assistant(s) standing next to the side of an operating table while an x-ray source is irradiating a patient, the surgeon and assistant(s) usually wear leaded eyeglasses, a lead thyroid covering and a lead apron which covers the chest, abdomen and thighs but leaves uncovered the arms, hands, legs below the knees and head. The radiation protection is only partially effective in blocking radiation and leaves substantial parts of the body uncovered. The amount of back-scattered x-ray radiation incident on the surgeon and assistant(s), particularly during the cine mode, is believed to be substantial enough to cause damage to the surgeon and assistant(s) over a prolonged time period.

In some instances, the surgeon and assistant(s) stand behind lead shield panels that are transparent to optical energy but substantially opaque to x-rays. The lead shield panels are typically unitary structures fixedly mounted on frames carrying casters, as disclosed in my U.S. Pat. No. 5,185,778, incorporated herein by reference.

The panels are made of lead glass having sufficient thickness to substantially attenuate the back-scattered x-rays and thereby protect the surgeon and assistants. The panels do not enable the surgeon and/or assistants easy access to the patient during the operating procedure. Consequently, if access to the patient is necessary during the procedure and while the patient is being x-rayed, there is a high likelihood of sensitive body portions of the surgeon and/or assistant(s) being irradiated with undesirable doses of back-scattered x-ray radiation.

It is, accordingly, an object of the present invention to provide a new and improved method of and apparatus for shielding surgeons and/or assistants from x-rays during surgery while x-rays are being used for diagnostic purposes.

An additional object of the present invention is to provide a new and improved method of and apparatus for shielding critical body parts of surgeons and/or assistant(s) during an operating procedure that is accompanied by a patient being exposed to diagnostic x-rays, wherein the shield arrangement enables relatively easy access to the patient.

Another object of the present invention is to provide a new and improved shield panel arrangement for an operating room including x-ray diagnostic equipment, wherein the shield panel arrangement includes moving parts that are relatively easily moved, despite the substantial weight and density of the shield panels.

SUMMARY OF THE INVENTION

According to one aspect of the invention, there is provided an apparatus for reducing back-scattered x-rays incident on a person working with a patient on an operating table, wherein the patient is exposed to x-rays from an x-ray source while on the table so that the back-scattered x-rays result from x-rays from the source being incident on the patient and/or table. The apparatus comprises an upper x-ray shield panel and a lower x-ray shield panel arrangement. The upper x-ray shield panel and the lower x-ray shield panel arrangement have thicknesses between front and back faces thereof and respectively have lower and upper edges in close enough proximity to each other to substantially attenuate the back-scattered x-rays incident on (a) the front face of the upper x-ray shield panel, (b) the lower x-ray shield panel arrangement, and (c) a gap between the edges while the front faces of the upper x-ray shield panel and lower x-ray shield panel arrangement are aligned and parallel to a proximate edge of the operating table. The upper shield panel is transparent to visible optical energy and pivotable about a vertical axis relative to the lower shield panel arrangement to enable one or both hands and one or both forearms of a person standing behind the back faces of the upper and lower shield panels to extend through an open region between the lower and upper edges. The opening results from pivoting of the upper x-ray shield panel relative to the lower x-ray shield panel arrangement about the vertical axis. The upper x-ray shield panel and lower x-ray shield panel arrangement together have a height and widths sufficiently greater than the height and width of the person standing behind the back faces of the upper panel and lower panel arrangement to substantially prevent the back-scattered x-rays incident on the front faces of the upper x-ray shield panel and the lower x-ray shield panel arrangement from being incident on the portion of the person behind the back faces while the front faces are aligned.

Preferably, the upper x-ray shield panel and the lower x-ray shield panel arrangement have aligned vertically extending edges that are substantially coincident with the vertical axis. Another x-ray shield panel is preferably provided. The another x-ray shield panel has front and back faces and a vertically extending edge in sufficiently close proximity to the aligned vertically extending edges of the upper x-ray shield panel and lower x-ray shield panel arrangement to substantially attenuate the back-scattered x-rays incident on (1) the aligned vertically extending edges of the upper x-ray shield panel and the lower x-ray shield panel arrangement and (2) the vertically extending edge of the another x-ray shield panel. The front face of the another x-ray shield panel is positionable at a non-zero angle, e.g. 90°, relative to the front faces of the upper x-ray shield panel and the lower x-ray shield panel arrangement.

The another x-ray shield panel preferably has a height equal to or greater than the combined heights of the upper x-ray shield panel and the lower x-ray shield panel arrangement.

The vertically extending edge of the another x-ray shield panel is preferably pivotable relative to the aligned vertically extending edges of the upper x-ray shield panel and the lower x-ray shield panel arrangement to enable the another panel to be turned by a suitable angle, e.g., 90°, relative to the aligned upper panel and lower panel arrangement and the proximate edge of the operating table.

Preferably, to maximize attenuation of back-scattered x-rays, the another x-ray shield panel has a horizontal extent substantially at a right angle to the faces and a first segment extending slightly beyond the front faces toward the operating table and a second segment extending by a substantial distance beyond the back faces away from the operating table.

In one embodiment, the lower x-ray shield panel arrangement includes a single x-ray shield panel.

In a second embodiment, the lower x-ray shield panel arrangement includes first and second x-ray shield panels, arranged so the first panel is generally above the second panel. The first x-ray shield panel has (1) a lower edge and (2) an upper edge corresponding with the upper edge of the lower x-ray shield panel arrangement. The second x-ray shield panel has an upper edge below the lower edge of the first x-ray shield panel and a lower edge in close proximity to the floor or on the floor. The first and upper x-ray shield panels are arranged so they can have different vertical positions so that the gap between the upper edge of the first x-ray shield panel and the lower edge of the upper x-ray shield panel is maintained constant at the different vertical positions. The first and second x-ray shield panels are arranged so that (1) the upper and lower edges of the second x-ray shield panel are maintained at the same vertical position while the first and upper x-ray shield panels are at all of the different vertical positions, and (2) the upper edge of the second x-ray shield panel is above the lower edge of the first x-ray shield panel at all of the different vertical positions.

Preferably, the upper and first x-ray shield panels are drivingly connected to a pulley arrangement so the upper and first x-ray shield panels can be driven to the different vertical positions. The pulley arrangement includes a wheel and a counterweight. The counterweight is on a side of the wheel different from the upper and first x-ray shield panels and weighs about the same as the combined weights of the upper and first x-ray shield panels.

Another aspect of the invention relates to a method of using the foregoing apparatus to reduce back-scattered x-rays incident on a person working with a patient on an operating table.

The method comprises forming the open region between the bottom edge of the upper panel and the upper edge of the lower panel arrangement by causing the upper x-ray shield panel to be turned toward the operating table while maintaining the lower x-ray shield panel arrangement substantially parallel to a proximate edge of the table while the patient is exposed to x-rays from the x-ray source. One or both hands and one or both forearms of a person located behind the shield panels are extended through the open region while the patient is exposed to x-rays from the x-ray source while the remainder of the person is behind the back faces.

In those embodiments wherein the lower x-ray shield panel arrangement includes the first and second x-ray shield panels, the method preferably further comprises abutting the lower edge of the upper x-ray shield panel against an upper surface of the patient on the operating table after the table has been vertically locked in position for the comfort of the surgeon. Such a position of the upper panel aids in reducing back-scattered x-rays incident on the person while the patient is exposed to x-rays from the x-ray source and one or both hands and one or both forearms of the person extend through the open region while the remainder of the person is behind the back faces of the shield panels.

The above and still further objects, features and advantages of the present invention will become apparent upon consideration of the following detailed description of specific embodiments thereof, especially when taken in conjunction with the accompanying drawings.

DETAILED DESCRIPTION OF THE DRAWINGS

The preferred embodiment of the present invention is described in conjunction with a cardiac catheterization procedure. It is to be understood, however, that the principles of the invention are applicable to any surgical or radiological procedure wherein a patient is subject to x-ray radiation for prolonged time periods and an operator and assistant(s) attending the patient, e.g., a surgeon or radiologist and nurse (s), are subject to x-rays back-scattered from the patient and/or operating table on which the patient is lying.

Figure 1:
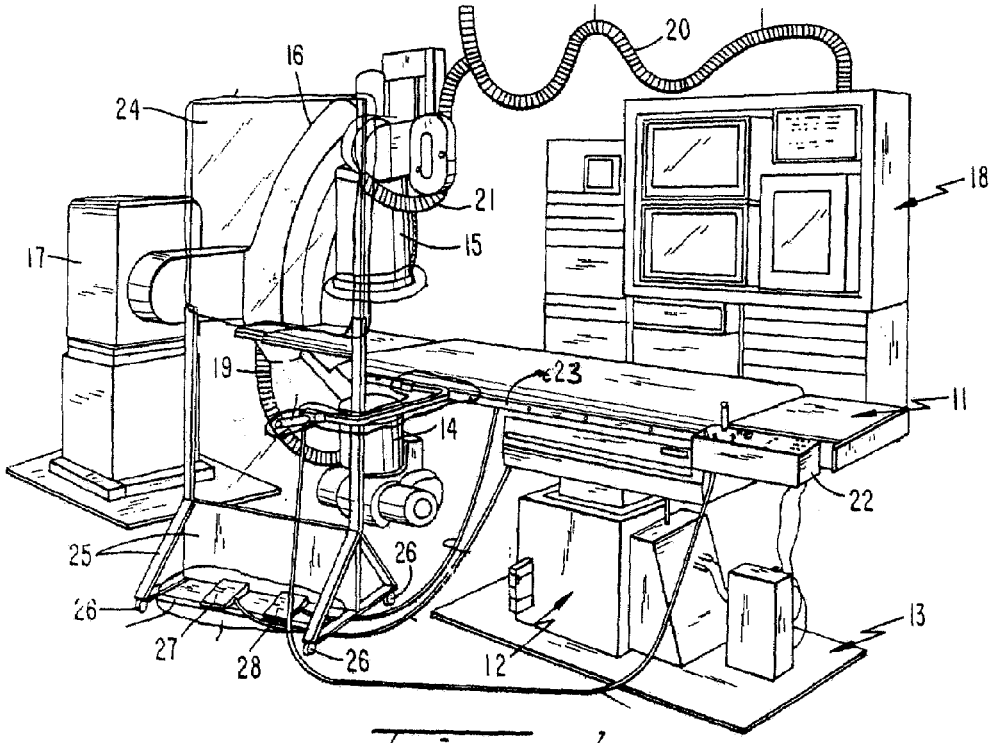
FIG. 1 is a perspective view of an operating room including a shield panel arrangement.
Figure 3:
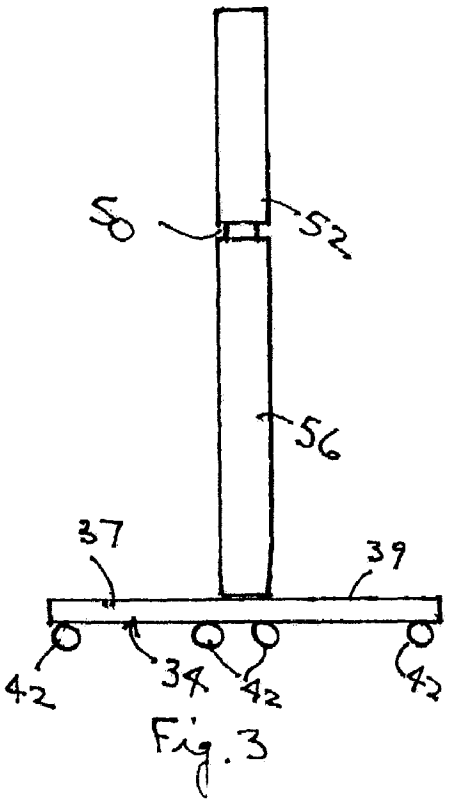
FIG. 3 is a side view of the structure illustrated in FIG. 2.
Figure 2:
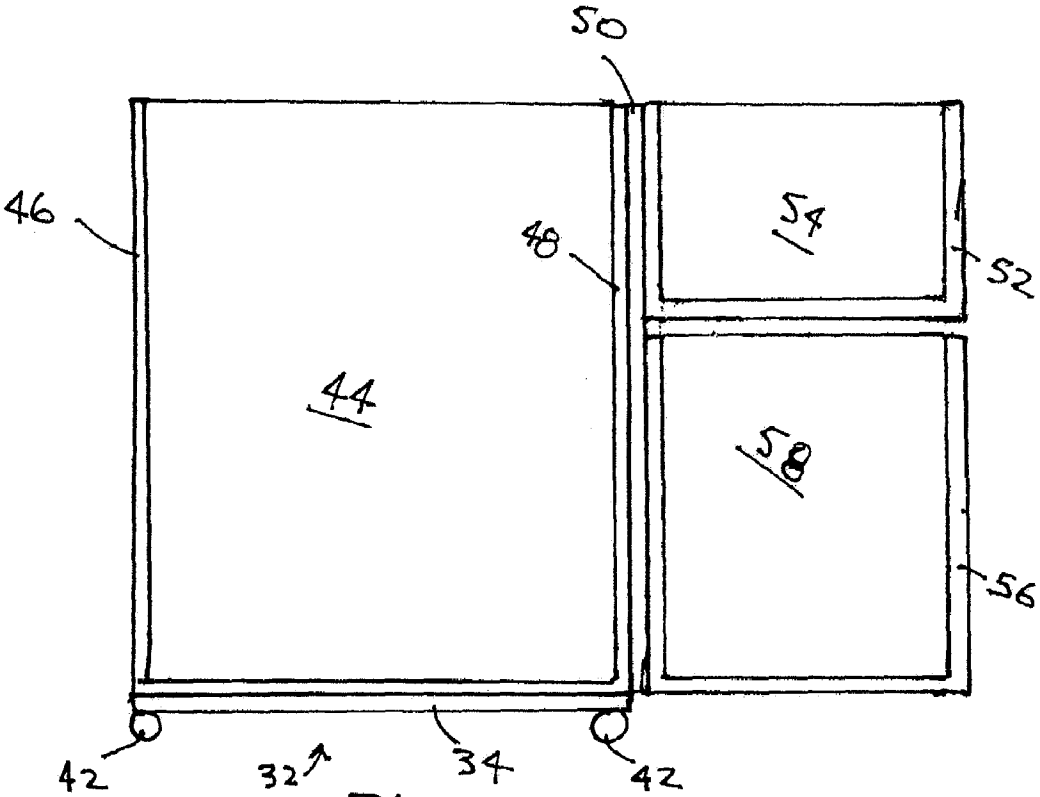
FIG. 2 is a front view of one embodiment of a shield arrangement including three panels for use in the operating room illustrated in FIG. 1.
Figure 4:
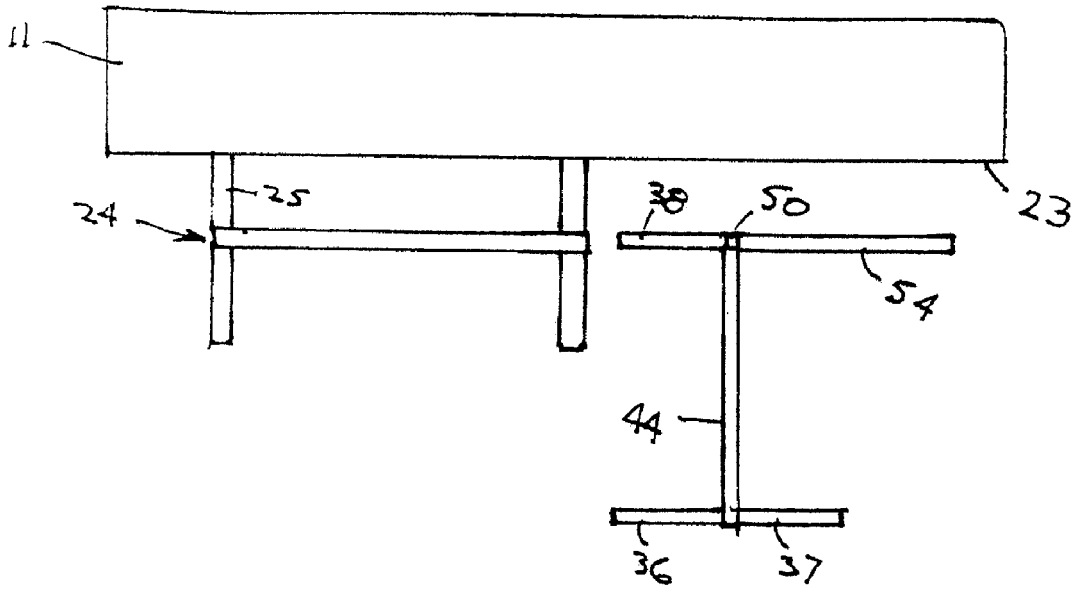
FIG. 4 is a top view of the structure illustrated in FIGS. 2 and 3, in combination with a shield panel as disclosed in my previously mentioned patent and an operating table wherein the three panels are in a first angular position with respect to each other.
Figure 5:
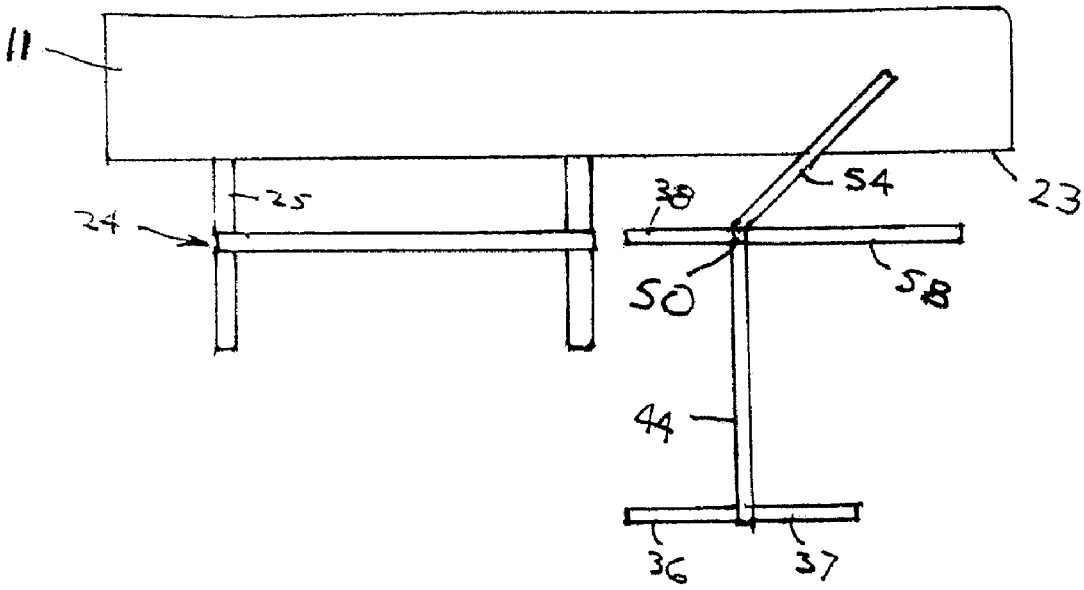
FIG. 5 is a top view similar to that illustrated in FIG. 4, but wherein the three shield panels arrangement are in a second angular position relative to each other.
Figure 6:
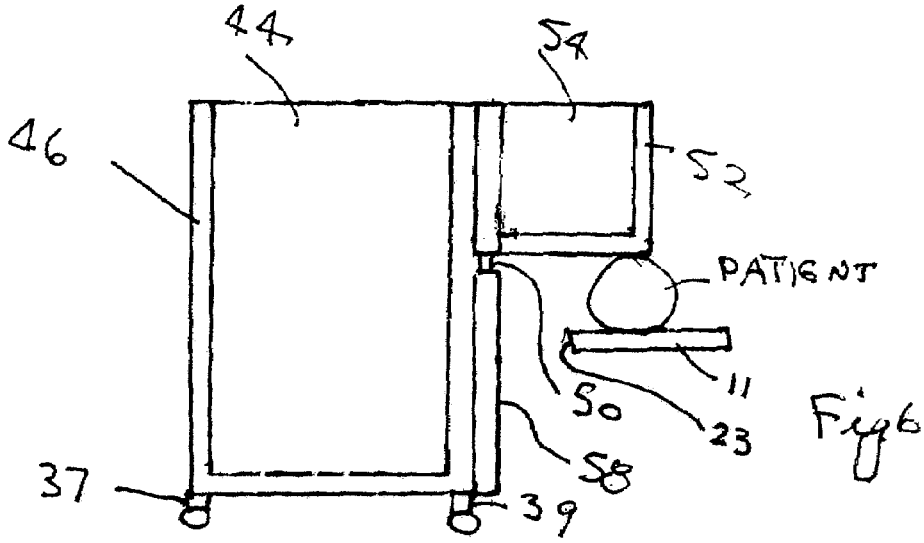
FIG. 6 is a side view of the arrangement of FIG. 5.

Reference is now made to FIG. 1 of the drawing wherein operating table 11 is mounted on platform 12, in turn fixedly mounted on floor 13 so that the operating table extends in a horizontal plane parallel to the floor. Platform 12 includes X-Y linkages (not shown) for moving table 11 in the horizontal plane in directions of X and Y axes and motors, as well as a braking mechanism, and an elevator (not shown) for driving table 11 up and down, i.e., in the direction of the z axis; the linkages, motors, braking mechanism and elevator are well known to those skilled in the art. The linkages and motors for the X and Y axes enable forces manually applied by the surgeon to the table during the procedure to move the table in the horizontal plane, even though a relatively heavy patient is lying on table 11. The X-Y linkages and motor in platform 12 are controlled by the surgeon selectively activating a button, so that when the button is pushed, the manually-imparted forces cause table 11 to move in the horizontal plane. When the button is not activated, the X-Y linkages and the motors in platform 12 are braked by the braking mechanism in the platform to prevent movement of table 11 relative to platform 12 and the floor 13. The z axis position of table 11 is established prior to the procedure being initiated so that the patient is at a height above floor 13 that enables the operator to perform the procedure with the greatest ease and comfort.

X-ray source 14 and x-ray detector 15, in the form of an image intensifier, are mounted on gantry 16 so that the tube and detector are mounted on opposite sides of table 11 while the patient is on the table. Gantry 16 is mounted for rotation on column 17, located on floor 13. Circuitry in x-ray source 14 and image-intensifier 15 is controlled by electric power and signals coupled to them from an x-ray controller (not shown) via cable 19. The x-ray image is transmitted via cable 20 from an x-ray controller (not shown) through the ceiling to video display 18. Power for the cine recorder is provided by cable 21. Typically, x-ray source 14 is activated to one of two different intensity levels, respectively referred to as the fluoroscopy and cine modes, such that the cine mode has an intensity level four times greater than that of the fluoroscopy mode. Control console 22 for the movement of table 11 as well as for x-ray source 14 is fixedly mounted on one end of operating table 11.

In a typical operating room, one or more lead impregnated plastic, optically transparent vertically extending x-ray shield panel(s) 24 is located in proximity to proximate side 23 of table 11. Each shield panel 24 is mounted on bracing structure 25, on which are mounted casters 26 for enabling the shield panel to be easily moved relative to platform 12 on floor 13. Shield panel 24 extends from about a foot above floor 13 to about 6½ feet above the floor and for about 3 feet from side to side so the entire body of a surgeon standing behind the panel is effectively shielded from x-rays back-scattered from table 11 and the patient lying on the table.

One or more additional shield panels 30 (only one of which is included in FIG. 1 for clarity) somewhat similar to shield panel 24 are usually included, such that one additional shield panel 30 is provided for each assistant to the operator who is standing next to table 11. Additional shield panel 30 does not include controllers for the movement of table 11 that are included on panel 24.

In the prior art, the additional panel 30 is a planar, structure that is mounted on casters. Panel 30 of the prior art does not enable the person standing behind the panel to assist the surgeon who is standing behind panel 24 while x-ray source 14 is activated, unless such a person is willing to step around panel 30 and risk x-ray exposure.

Hence, during the cine operation, while x-ray source 15 is activated, body parts of the persons who should be standing behind prior art panel 30 are irradiated by x-ray radiation back-scattered from the patient and table 11. Over a prolonged period of many years, such a person is likely to be subjected to considerable amounts of x-ray radiation back-scattered from the table and patients on which the cardiac catheterization procedure has been performed. The accumulated effects of the back-scattered radiation on the persons may lead to the persons becoming cancer victims.

As a result of the present invention, the prior art panel 30 is modified so persons standing behind an x-ray shield panel located around table 11 can participate with his/her hands in the procedure while x-ray source 14 is activated. The modified panel is such that one or both hands and forearms are the only parts of the person exposed to the back-scattered x-ray radiation. Exposure to x-rays by one or both hands and forearms is much less likely to result in cancer than exposure to x-rays by other body parts.

Reference is now made to FIGS. 2-6 of the drawing, illustrations of a first embodiment of a shield panel that can be placed where shield panel 30 is illustrated in FIG. 1. The shield panel of FIGS. 2-6 includes base 32, center leg 34 and exterior legs 36-39, fixedly connected to leg 34 and arranged so that legs 36 and 37 extend in opposite directions from one end of center leg 34 and legs 38, 39 extend in opposite directions from the other end of center leg 34. Opposite ends of legs 36-39 carry casters 42 that enable the shield panel of FIGS. 2-6 to be easily moved around the operating room.

Rectangular, x-ray shield panel 44 is fixedly mounted on and aligned with center leg 34 so panel 44 extends from the center leg upwardly in the vertical plane. The periphery of panel 44 is circumscribed by metal frame 46, having a vertically extending edge 48 that is substantially aligned with legs 38 and 39 and carries piano hinge 50. The upper portion of hinge 50 is attached to frame 52 that circumscribes upper x-ray shield panel 54. The lower part of hinge 50 is attached to a vertically extending edge of frame 56 that circumscribes lower x-ray shield panel 58 that can be considered as a lower x-ray shield panel arrangement.

Typically, x-ray shield panels 44, 54 and 58 are plastic panels embedded with lead so that they have a 1.0 or 2.0 mm lead equivalent, causing the plastic panels to be 22 or 46 mm thick. Frames 52 and 56 are hung on hinge 50 such that there is a gap 60 between the upper edge of frame 56 and the lower edge of frame 52. Because x-ray shield panels 54 and 58 extend within frames 52 and 56 virtually to the opposite sides of gap 60, gap 60 can be considered as the gap between the lower edge of shield panel 54 and the upper edge of shield panel 58. In a typical embodiment, gap 60 has a vertical extent, i.e., height, of ¾ inch. The thicknesses of panels 54 and 58 and the vertical length of gap 60 are such that back-scattered x-rays incident on the front face of panel 54, the front face of panel 58 and gap 60 are substantially attenuated and are not harmful to a person standing behind panels 54 and 58, when the panels are aligned in a plane, such that the front faces of the panels are approximately 2 inches from proximate edge 23 of operating table 11.

Upper shield panel 54 and lower shield panel 58 are dimensioned to cause a person standing behind panels 54 and 58 to be protected from back-scattered radiation from the patient being operated on and/or from table 11. To this end, in one embodiment panels 54 and 58 respectively have heights of 28½ and 44 inches, so that the total height of panels 54 and 58 and gap 60 is 73¼ inches, the same height as panel 44. Panels 54 and 58 have the same length in the horizontal plane of 24 inches while panel 44 has a length in the horizontal place of 30 inches. These dimensions are such that when panels 54 and 58 are aligned, panel 54 protects the head, upper torso, part of the midsection and arms and legs of the person, while panel 58 protects the remainder of the midsection, lower torso, legs and feet of the person. It is to be understood that the aforementioned dimensions are the preferred dimensions, but can be changed, as necessary, depending upon the height and girth of the person standing behind panels 54 and 58.

Panel 54 is transparent to visible optical energy, so that the person standing behind panels 54 and 58 can see what is happening on operating table 11 and participate in the operation, as necessary. Panels 44 and 58 can be transparent or opaque to visible optical energy, as desired.

In use, panel 44 is located at right angles to proximate edge 23 of operating table 11, so that one face of panel 44 abuts or is in very close proximity to an edge of panel 24. Panel 58 is positioned so that the front planar surface thereof is parallel to spaced approximately 2 inches from proximate 23 edge of operating table 11. When the person standing behind panels 54 and 58 is only observing what is happening on operating table 11, panel 54 is aligned with panel 58, so that both panels 54 and 58 are parallel to and approximately 2 inches from proximate edge 23 of operating table 11.

When the person standing behind panels 54 and 58 needs to participate in the operation, panel 54 is turned about hinge 50 to such an extent that the person standing behind panels 54 and 58 can place one or both of its hands and one or both of its forearms through the opening between panels 54 and 58 created by panel 54 being turned toward the proximate edge 23 of operating table 11. Preferably, the height of table 11 is adjusted so the lower edge of panel 54 lies on a body part of the patient on operating table 11, typically the legs of the patient, to minimize radiation back-scattered from the patient and/or table 11 through the opening resulting from panel 54 being turned about hinge 50. If necessary, panel 54 can be turned 90 degrees relative to panel 58, so that panels 44 and 54 are both at right angles to the proximate edge 23 of operating table 11. If necessary or desirable, panel 58 is turned about hinge 50 so that the vertical edge of panel 58 that is remote from hinge 50 contacts proximate edge 23 of operating table 11.

According to a modification of the shield arrangement of FIGS. 2-6, the upper shield panel and lower shield panel arrangement are such that the lower edge of the upper shield panel can always be turned so that it contacts the body of the patient and the gap between the lower edge of the upper shield panel and the upper edge of the lower shield arrangement is maintained constant. Such a modification is illustrated in FIGS. 7-9.

Figure 7:
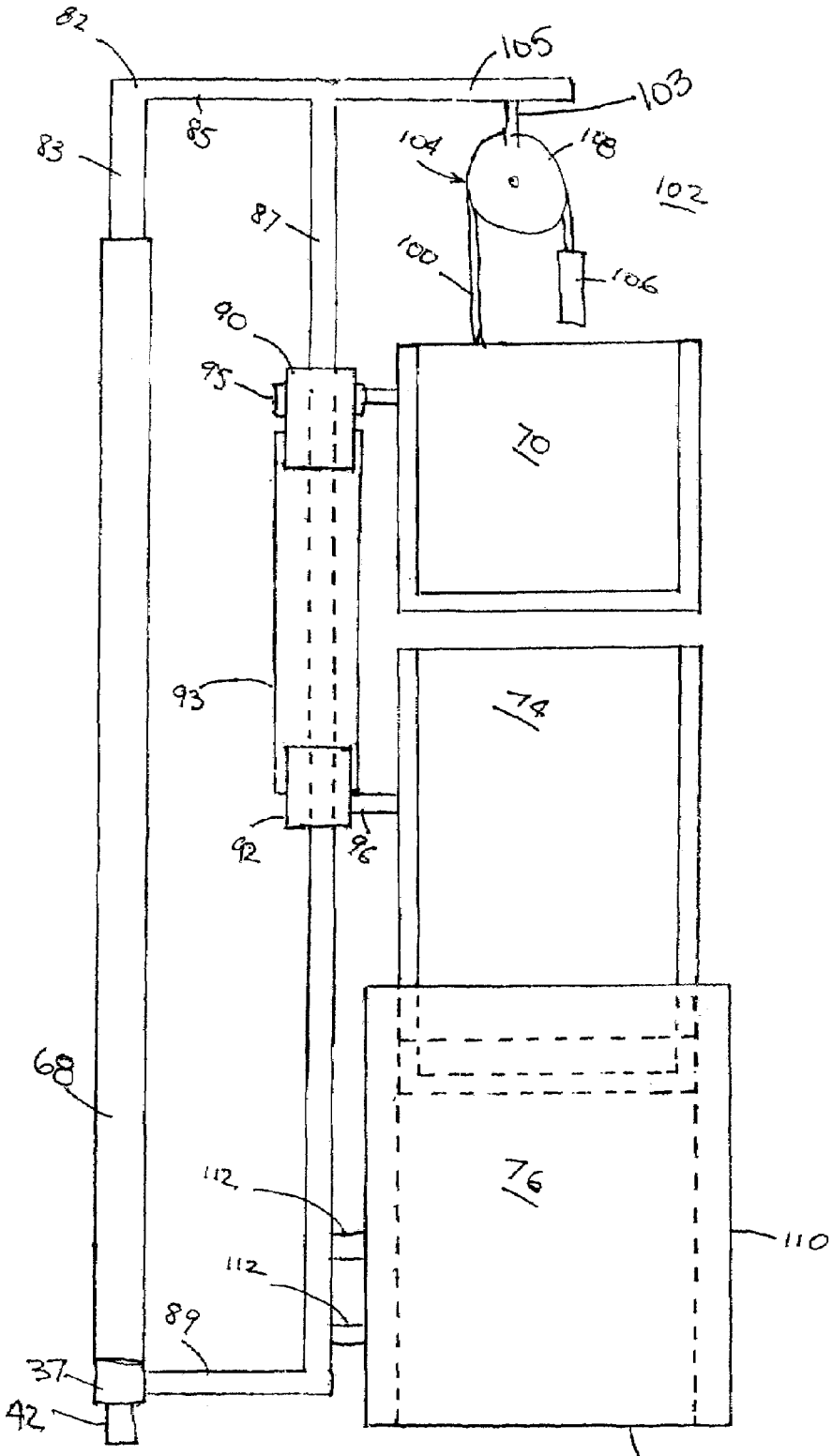
FIG. 7 is a side, somewhat schematic view of a second embodiment of a shield panel arrangement that can be used in the operating room of FIG. 1.
Figure 8:
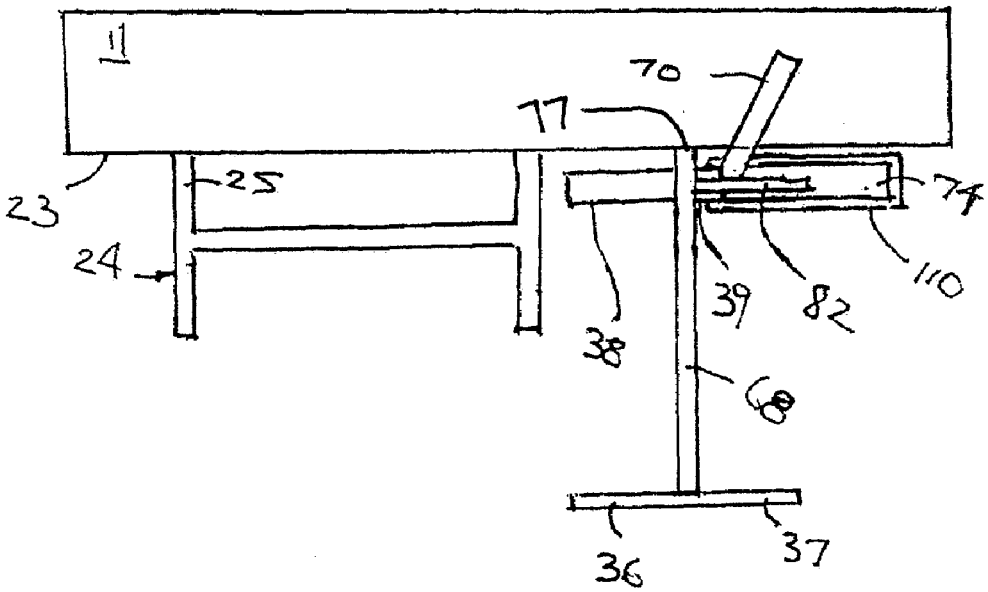
FIG. 8 is a top view of the structure illustrated in FIG. 7.
Figure 9:
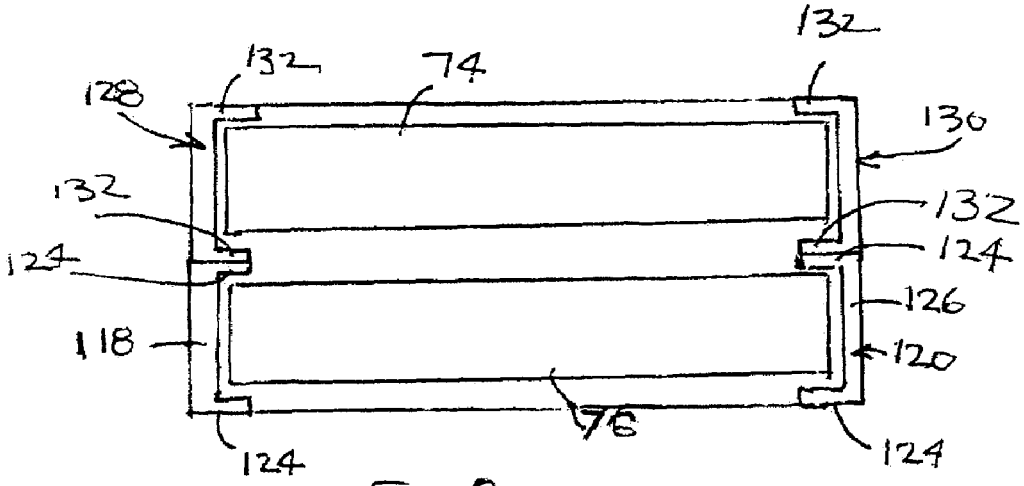
FIG. 9 is a top view of first and second shield panels forming a lower shield panel arrangement of FIGS. 7 and 8 and a structure that captures and maintains the first and second shield panels horizontally fixed relative to each other while enabling vertical movement of the first shield panel relative to the fixed vertical position of the second shield panel.

In the embodiment of FIGS. 7-9, base 32 and casters 42 are identical to the arrangement of FIGS. 2-6. In the embodiment of FIGS. 7-9, shield panel 68 is similar, but slightly different from panel 44, but upper shield panel 70 is identical to upper shield panel 54 of the embodiment of FIGS. 2-6. However, mounting of upper shield panel 70 is quite different from mounting of shield panel 54.

Lower shield panel arrangement 72 in the embodiment of FIGS. 7-9 includes a first, upper panel 74 and a second, lower panel 76. Panel 74 is mounted relative to panel 70 so that the upper edge of panel 74 and the lower edge of panel 70 have a ¾ inch constant height gap 78 between them, despite the fact that panels 70 and 74 can be raised together and the lower edge of panel 70 can be swung outwardly to engage an upper surface of the body of the patient, such as the top of the patient's legs. Panel 76 is fixedly mounted so that the bottom edge thereof abuts or is slightly above the operating room floor on which casters 42 rest. Panels 74 and 76 are dimensioned and mounted so that the upper edge of panel 76 is always above the lower edge of panel 74 and the back planar face of panel 74 and the front planar face of panel 76 always remain parallel and in close proximity to each other, so that the person standing behind panels 70, 74 and 76 is shielded from back-scattered x-rays incident on the front face of panel 74. When panels 70, 74 and 76 are parallel to each other, panel 70 protects the head, upper torso, arms and hands of the person, panel 74 protects the midsection and the upper and middle leg portions of the person and panel 76 protects the middle and lower leg portions and feet of the person.

In one preferred embodiment, panels 68, 70, 74 and 76 have the same thickness of 22 or 46 mm. Panel 68 has a height of 73¼ inches and a width of 32 inches between its vertical edges; each of panels 70, 74 and 76 has a width of 30 inches between its vertical edges; panel 70 has a height of 28½ inches; panel 74 has a height of 34 inches and panel 76 has a height of 26 inches; and the gap between the top edge of panel 76 and the bottom edge of panel 74 is ¾ inch. Such dimensions provide the required protection for most persons who stand behind panels 70, 74 and 76.

Panels 70, 74 and 76 are coupled to panel 68 and panel 68 is constricted in such a manner that front edge 77 of panel 68 extends to the proximate edge 23 of table 11 when the front, planar faces of panels 70, 74 and 76 are parallel to and spaced from the proximate edge 23 of table 11 by a distance of 2 inches. Because of the abutting relationship of front edge 77 of panel 68 with the proximate edge 23 of table 11, the amount of back-scattered radiation from the table and patient that is incident on the person standing behind panels 70, 74 and 76 is substantially reduced.

The structure 80 for coupling panels 70, 74 and 76 to panel 68 includes rod or tube 82 that is fixedly connected to the top of panel 68 and includes leg 83 that extends upwardly from the top edge of panel 68 by a suitable distance, e.g., 1 foot. The connection point of tube 82 to the top edge of panel 68 is horizontally aligned with panels 70, 74 and 76 when panels 70, 74 and 76 are positioned so that the front faces thereof are parallel to proximate edge 23 of table 11, i.e., the base of tube 82 is 2 inches from the edge of panel 68 that abuts the proximate edge 23 of table 11. Tube 82 has a right angle bend 12 inches above the top edge of panel 68, to form leg 85 that extends horizontally in a plane aligned with panels 70, 74 and 76. The horizontal extent of leg 85 is 2 inches, to another right angle bend, at which tube 82 extends downwardly in the vertical plane to form leg 87. Leg 87 extends downwardly to a point aligned with base 32, where tube 82 has a further right angle bend to form leg 89 that extends horizontally in a plane aligned with the plane of panels 74 and 76. The end of leg 89 remote from panels 76 and 78 is fixedly connected to base 82. Tube 82 thus forms a rigid structure that ultimately carries panels 70, 74 and 76 so panel 70 can turn about a vertical axis defined by the axis of leg 87. Panels 74 and 76 are mounted so they stay in planes substantially parallel to proximate edge 23 of table 11.

To enable panels 70 and 74 to be raised and lowered together and to enable panel 70 to be turned about the vertical axis of leg 87 while panels 74 and 76 remain parallel to edge 23, panels 70 and 74 are respectively fixedly mounted on sleeves 90 and 92 that are concentric with and slidable relative to the length of long leg 87 of tube 82. The bottom portion of sleeve 90 is connected to the top portion of sleeve 92 by flexible coupling 93 that enables sleeve 90 to turn about leg 87 relative to sleeve 92 while maintaining a constant vertical separation of ¾ inch between the bottom edge of sleeve 90 and the top edge of sleeve 92. To this end, the bottom portion of sleeve 90 is fixedly connected to the top portion of flexible coupling 93 and the top portion of sleeve 92 is fixedly connected to the bottom portion of coupling 93. Coupling 93 has sufficient lengthwise stiffness, i.e., stiffness in the vertical direction, to maintain the distance between the lower edge of panel 70 and the upper edge of panel 74 constant, even though the coupling is turned through an angle about its longitudinal axis in excess of 90°. As described infra, panel 76 remains in situ while panels 90 and 92 are moved up and down together and panel 70 is turned relative to panels 74 and 76. Sleeves 90 and 92 are connected to the proximate edges of panels 70 and 74 by clamps 95 and 96, respectively. Clamp 96 rigidly and fixedly holds panel 74 to sleeve 92, while clamp 95 is arranged so that one end thereof is fixedly connected to panel 70 and the other end is selectively fastened and released from sleeve 90. Clamp 95 is released from sleeve 90 while panel 70 is turned about leg 87 of rod 82. When panel 70 has been turned to the desired angle about leg 87, clamp 95 is fastened to sleeve 90 so panel 70 remains at the desired angular position relative to leg 87; for example, panel 70 can be turned so that at a first position panels 70 and 74 are aligned and at a second position, panel 70 is turned 90° relative to panel 74 so the faces of panels 68 and 70 are in parallel planes.

Pulley system 102 that includes metal pulley cable 100 enables panels 70 and 74 to be raised and lowered together so that gap 78 between the upper edge of panel 74 and the lower edge of panel 70 remains constant. Opposite ends of pulley cable 100 are connected to the top edge of panel 70 and counterweight 106 so that panels 70 and 76 are raised and lowered by moving pulley cable 100 up and down. Pulley system 102 also includes pulley wheel assembly 104, mounted on by swivel 103 horizontally extending leg 105 that is aligned with leg 85 of rod 82, so that assembly 104 is free to turn as panel 70 turns. Pulley wheel assembly 104 comprises pulley wheel 108 having a circumferential groove about which cable 100 is wound and a cable brake (not shown). The cable brake of pulley wheel assembly 104 is applied when the bottom edge of panel 70 is at the desired position, i.e., at a position so that the bottom edge of panel 70 contacts the body of the person being operated on. Adjustment of the height of the bottom edge of panel 70 is easily provided in a precise manner by appropriate selection of the weight of counterweight 102, so that the counterweight and the combined weights of panels 70 and 74, that can exceed 1,000 pounds, are closely matched.

Rack 110, fixedly mounted to rod 82 by pins 112, maintains panels 74 and 76 in planes parallel to each other and parallel to the proximate edge 23 of operating table 11. Rack 110 enables panel 74 to be driven up and down by cable 82, but holds panel 76 firmly in place. Rack 110 has a height less than the minimum height of the upper edge of panel 74 above the operating room floor so that a portion of panel 74 always extends above the upper edge of rack 110.

Rack 110 includes base 116 that is fixedly positioned slightly above the operating room floor when the shield arrangement of FIGS. 7-9 is in place. The bottom edge of panel 76 rests on base 116, and the side edges of panel 76 are fixedly captured by interior surfaces of vertically extending channels 118 and 120 (FIG. 9), such that flanges 122 of channels 118 and 120 capture the front and back faces of panel 76, and the interior surfaces of the elongated, vertically extending bases 126 of channels 118 and 120 capture the opposite vertically extending edges of panel 76.

Rack 110 also includes channels 128 and 130 that hold panel 74 in place. Channels 128 and 130 include flanges 132 that capture the front and back faces of panel 74, as well as elongated, vertically extending bases 134 that capture the opposite edges of panel 74. The interior flanges 124 and 132 of channels 118, 120, 128 and 130 have abutting faces that are welded together so that rack 110 is formed as a unitary structure in which panel 76 is maintained at a fixed, constant position, while panel 74 is free to move up and down relative to panel 76, but panel 74 can not turn appreciably relative to panel 76 due to the way panel 74 fits in channels 128 and 130.

Prior to an operation on a patient commencing, the surgeon adjusts the height of table 11 above the operating room floor so that the patient is located at a position where the surgeon is comfortable while operating on the patient. Then, the shield assembly of FIGS. 7-9 is wheeled into place so that the forward edge 77 of panel 68 abuts the proximate edge 23 of operating table 11, while panels 70, 74 and 76 are locked in place at a position, such that (1) the front faces of panels 70, 74 and 76 are parallel to the proximate edge 23 of operating table 11, and (2) the upper edge of panel 74 and the lower edge of panel 70 are above the legs of the person being operated on. Hence, clamp 95 is fixedly connected to sleeve 90 and the brake of pulley wheel assembly 104 is engaged at this time. Then, clamp 95 is released and sleeve 90 is turned about leg 87 of cable 82, so that panel 70 extends above the patient on the operating table. Then, clamp 95 is locked to sleeve 90, so that flexible coupling 93 is twisted through an angle equal to the angular displacement of panel 70 from panel 74. Then, the brake of pulley wheel assembly 104 is released and leg 87 of cable 82 is pulled downwardly until the bottom edge of panel 70 rests on the legs of the person being operated on. Then, the brake of pulley wheel assembly 104 is activated, to lock cable 100 at a fixed vertical position, so that the fixed vertical positions of panels 70 and 74 are locked. Then, clamp 95 is released and panel 70 is turned about leg 87 of tube 82, so that the front face of panel 70 is parallel to proximate edge 23 of operating table 11. If the person standing behind panels 70, 74 and 76 is required to participate in the operation, clamp 95 is released and panel 70 is turned toward operating table 11, about leg 87 of tube 82, until panel 70 is at the required angle. Then, clamp 95 is tightened, so that panel 70 is maintained at the desired angle, to provide an opening through which the hand or hands and forearm or forearms of the person standing behind panels 70, 74 and 76 can extend to enable such a person to participate in the operation. Flexible coupling 93 is then twisted through an angle equal to the angular displacement of panel 70 from panel 74. When it is desired to re-align panels 70 and 74 or upon completion of the operation, the foregoing steps are reversed.

While a specific embodiment of the invention has been described and illustrated, variations regarding details of the embodiments specifically illustrated and described may be made without departing from the true spirit and scope of the invention as defined in the appended claims. For example, standard controllers, as well as the controllers described in my aforementioned patent, can be mounted on the panels of both embodiments, if necessary or appropriate. In addition, the spacing between the bottom edge of panel 54 and the top edge of panel 58 and the spacing between the bottom edge of panel 70 and the top edge of panel 74 can be any suitable distance less than ¾ inch, as long is there is sufficient spacing between these edges to enable the upper panel to turn relative to the lower panel.

What is claimed is:

1. Apparatus for reducing back-scattered x-rays incident on a person working with a patient on an operating table, the patient being exposed to x-rays from an x-ray source while on the table so that the back-scattered x-rays result from x-rays from the source being incident on the patient and/or table, the apparatus comprising an upper x-ray shield panel and a lower x-ray shield panel arrangement, the upper x-ray shield panel and the lower x-ray shield panel arrangement having thicknesses between front and back faces thereof and respectively having lower and upper edges in close enough proximity to each other to substantially attenuate the back-scattered x-rays incident on (a) the front face of the upper x-ray shield panel, (b) the lower x-ray shield panel arrangement, and (c) a gap between the edges while the front faces of the upper x-ray shield panel and lower x-ray shield panel arrangement are aligned, the upper shield panel being transparent to visible optical energy and pivotable about a vertical axis relative to the lower shield panel arrangement to enable one or both hands and one or both forearms of a person standing behind the back faces of the upper and lower shield panels to extend through an open region between the lower and upper edges resulting from pivoting of the upper x-ray shield panel relative to the lower x-ray shield panel arrangement about the vertical axis, the upper x-ray shield panel and lower x-ray shield panel arrangement together having a height and widths sufficiently greater than the height and width of the person standing behind the back faces so as to substantially prevent the back-scattered x-rays incident on the front faces of the upper x-ray shield panel and the lower x-ray shield panel arrangement while the front faces are aligned from being incident on the portion of the person behind the back faces.

2. The apparatus of claim 1 wherein the upper x-ray shield panel and the lower x-ray shield panel arrangement have aligned vertically extending edges that are substantially coincident with the vertical axis, and further including another x-ray shield panel having front and back faces and a vertically extending edge in sufficiently close proximity with the aligned vertically extending edges of the upper x-ray shield panel and lower x-ray shield panel arrangement to substantially attenuate the back-scattered x-rays incident on the aligned vertically extending edges of the upper x-ray shield panel and the lower x-ray shield panel arrangement and the vertically extending edge of the another x-ray shield panel, the front face of the another x-ray shield panel being positionable at a non-zero angle relative to the front faces of the upper x-ray shield panel and the lower x-ray shield panel arrangement.

3. The apparatus of claim 2 wherein the another x-ray shield panel has a height substantially equal to the combined heights of the upper x-ray shield panel and the lower x-ray shield panel arrangement.

4. The apparatus of claim 3 wherein the vertically extending edge of the another x-ray shield panel is pivotable relative to the aligned vertically extending edges of the upper x-ray shield panel and the lower x-ray shield panel arrangement.

5. The apparatus of claim 4 wherein the another x-ray shield panel has a horizontal extent substantially at a right angle to the faces and a first segment extending slightly beyond the front faces toward the operating table and a second segment extending by a substantial distance beyond the back faces away from the operating table.

6. The apparatus of claim 5 wherein the lower x-ray shield panel arrangement includes a single x-ray shield panel.

7. The apparatus of claim 5 wherein the lower x-ray shield panel arrangement includes first and second x-ray shield panels, the first x-ray shield panel having an upper edge corresponding with the upper edge of the lower x-ray shield panel arrangement and a lower edge, the second x-ray shield panel having an upper edge below the lower edge of the first x-ray shield panel and a lower edge in close proximity to the floor or on the floor, the first and upper x-ray shield panels being arranged to be able to have different vertical positions so that the gap between the upper edge of the first x-ray shield panel and the lower edge of the upper x-ray shield panel is maintained constant at the different vertical positions, the first and second x-ray shield panels being arranged so that the upper and lower edges of the second x-ray shield panel are maintained at the same vertical position while the first and upper x-ray shield panels are at all of the different vertical positions and the upper edge of the second x-ray shield panel is above the lower edge of the first x-ray shield panel at all of the different vertical positions.

8. The apparatus of claim 7 further including a pulley arrangement to which the upper and first x-ray shield panels are drivingly connected so the upper and first x-ray shield panels can be driven to the different vertical positions, the pulley arrangement including a wheel and a counterweight, the counterweight being on a side of the wheel different from the upper and first x-ray shield panels, the counterweight having a weight approximately equal to the combined weights of the upper and first x-ray shield panels.

9. The apparatus of claim 2 wherein the vertically extending edge of the another x-ray shield panel is pivotable relative to the aligned vertically extending edges of the upper x-ray shield panel and the lower x-ray shield panel arrangement.

10. The apparatus of claim 2 wherein the another x-ray shield panel has a horizontal extent substantially at a right angle to the faces and a first segment extending slightly beyond the front faces toward the operating table and a second segment extending by a substantial distance beyond the back faces away from the operating table.

11. The apparatus of claim 1 wherein the lower x-ray shield panel arrangement includes a single x-ray shield panel.

12. The apparatus of claim 1 wherein the lower x-ray shield panel arrangement includes first and second x-ray shield panels, the first x-ray shield panel having an upper edge corresponding with the upper edge of the lower x-ray shield panel arrangement and a lower edge, the second x-ray shield panel having an upper edge below the lower edge of the first x-ray shield panel and a lower edge in close proximity to the floor or on the floor, the first and upper x-ray shield panels being arranged to be able to have different vertical positions so that the length of the gap between the upper edge of the first x-ray shield panel and the lower edge of the upper x-ray shield panel is maintained constant at the different vertical positions, the first and second x-ray shield panels being arranged so that the upper and lower edges of the second x-ray shield panel are maintained at the same vertical position while the first and upper x-ray shield panels are at all of the different vertical positions and the upper edge of the second x-ray shield panel is above the lower edge of the first x-ray shield panel at all of the different vertical positions.

13. The apparatus of claim 12 further including a pulley arrangement to which the upper and first x-ray shield panels are drivingly connected so the upper and first x-ray shield panels can be driven to the different vertical positions, the pulley arrangement including a pulley and a counterweight, the counterweight being on a side of the pulley different from the upper and first x-ray shield panels, the counterweight having a weight approximately equal to the combined weights of the upper and first x-ray shield panels.

14. The apparatus of claim 1 in combination with at least one of the tables and the x-ray source.

15. A method of reducing back-scattered x-rays incident on a person working with a patient on an operating table, the patient being exposed to x-rays from an x-ray source while on the table so that the back-scattered x-rays result from x-rays from the source being incident on the patient and/or table, the apparatus comprising an upper x-ray shield panel and a lower x-ray shield panel arrangement, the upper x-ray shield panel and the lower x-ray shield panel arrangement having thicknesses between front and back faces thereof and respectively having lower and upper edges in close enough proximity to each other to substantially attenuate the back-scattered x-rays incident on the front faces of the upper x-ray shield panel, the lower x-ray shield panel arrangement and a gap between the edges while the front faces of the upper x-ray shield panel and lower x-ray shield panel arrangement are aligned, the upper shield panel being transparent to visible optical energy and pivotable about a vertical axis relative to the lower shield panel arrangement to enable one or both hands and one or both forearms of a person standing behind the back faces of the upper and lower shield panels to extend through an open region between the lower and upper edges resulting from pivoting of the upper x-ray shield panel relative to the lower x-ray shield panel arrangement about the vertical axis, the upper x-ray shield panel and lower x-ray shield panel arrangement together having a height and widths sufficiently greater than the height and width of the person standing behind the back faces so as to substantially prevent the back-scattered x-rays incident on the front faces of the upper x-ray shield panel and the lower x-ray shield panel arrangement while the front faces are aligned from being incident on the person, the method comprising causing the upper x-ray shield panel to be turned toward the table and maintaining the lower x-ray shield panel arrangement substantially parallel to an edge of the table while the patient is exposed to x-rays from the x-ray source to form the open region, extending one or both hands and one or both forearms through the open region while the patient is exposed to x-rays from the x-ray source while the remainder of the person is behind the back faces.

16. The method of claim 15 wherein the lower x-ray shield panel arrangement includes first and second x-ray shield panels, the first x-ray shield panel having an upper edge corresponding with the upper edge of the lower x-ray shield panel arrangement and a lower edge, the second x-ray shield panel having an upper edge below the lower edge of the first x-ray shield panel and a lower edge in close proximity to the floor or on the floor, the first and upper x-ray shield panels being arranged to be able to have different vertical positions so that the length of the gap between the upper edge of the first x-ray shield panel and the lower edge of the upper x-ray shield panel is maintained constant at the different vertical positions, the first and second x-ray shield panels being arranged so that the upper and lower edges of the second x-ray shield panel are maintained at the same vertical position while the first and upper x-ray shield panels are at all of the different vertical positions and the upper edge of the second x-ray shield panel is above the lower edge of the first x-ray shield panel at all of the different vertical positions, the method further comprising causing the lower edge of the upper x-ray shield panel to abut an upper surface of the patient on the operating table while the patient is exposed to x-rays from the x-ray source and one or both hands and one or both forearms of the person extend through the open region while the remainder of the person is behind the back faces.

* * * * *